United States Patent [19]

Thomas, Jr.

[11] 4,163,348

[45] Aug. 7, 1979

[54] PARTITION HAVING STABILIZING BAR AND METHOD

[76] Inventor: Donald K. Thomas, Jr., 1710 Laurel St., South Pasadena, Calif. 91030

[21] Appl. No.: 937,226

[22] Filed: Aug. 28, 1978

[51] Int. Cl.[2] ..... E04C 2/56

[52] U.S. Cl. ..... 52/241; 52/291

[58] Field of Search ..... 52/241, 223, 291, 222, 52/227, 741, 238, 584, 582

[56] References Cited

U.S. PATENT DOCUMENTS

| | | | |
|---|---|---|---|
| 1,895,667 | 1/1933 | Junkers | 52/223 R |
| 2,311,170 | 2/1943 | Hain | 52/223 R |
| 2,360,500 | 10/1944 | Johnson | 52/222 |
| 2,630,606 | 3/1953 | Joyce | 52/291 |
| 3,286,424 | 11/1966 | Weyant | 52/291 |
| 3,893,273 | 7/1975 | Sailor | 52/291 |

*Primary Examiner*—John E. Murtagh
*Attorney, Agent, or Firm*—Huebner & Worrel

[57] ABSTRACT

A partition formed of two spaced panels forming outer wall surfaces. The partitions are spaced by a paper honeycomb structure, passages in the honeycomb being substantially perpendicular to the panels. There are elongated H-shaped members fitted on each of two opposite ends of the panels, the H-bar of the members being adjacent the panel end edges. There is a partition stabilizing bar extending centrally between the panels and extending through a space between two sections of the honeycomb. The stabilizing bar is threaded at both ends and secured to and through the H-bars of the H-shaped members so as to prevent bowing or collapse of the partition in the direction of the bar.

The method includes the steps of putting the partition together, particularly the steps of inserting the stabilizing bar between the honeycomb sections after they have been secured between the panels and of securing the stabilizing bar to the H-shaped members.

7 Claims, 3 Drawing Figures

FIG. 1.
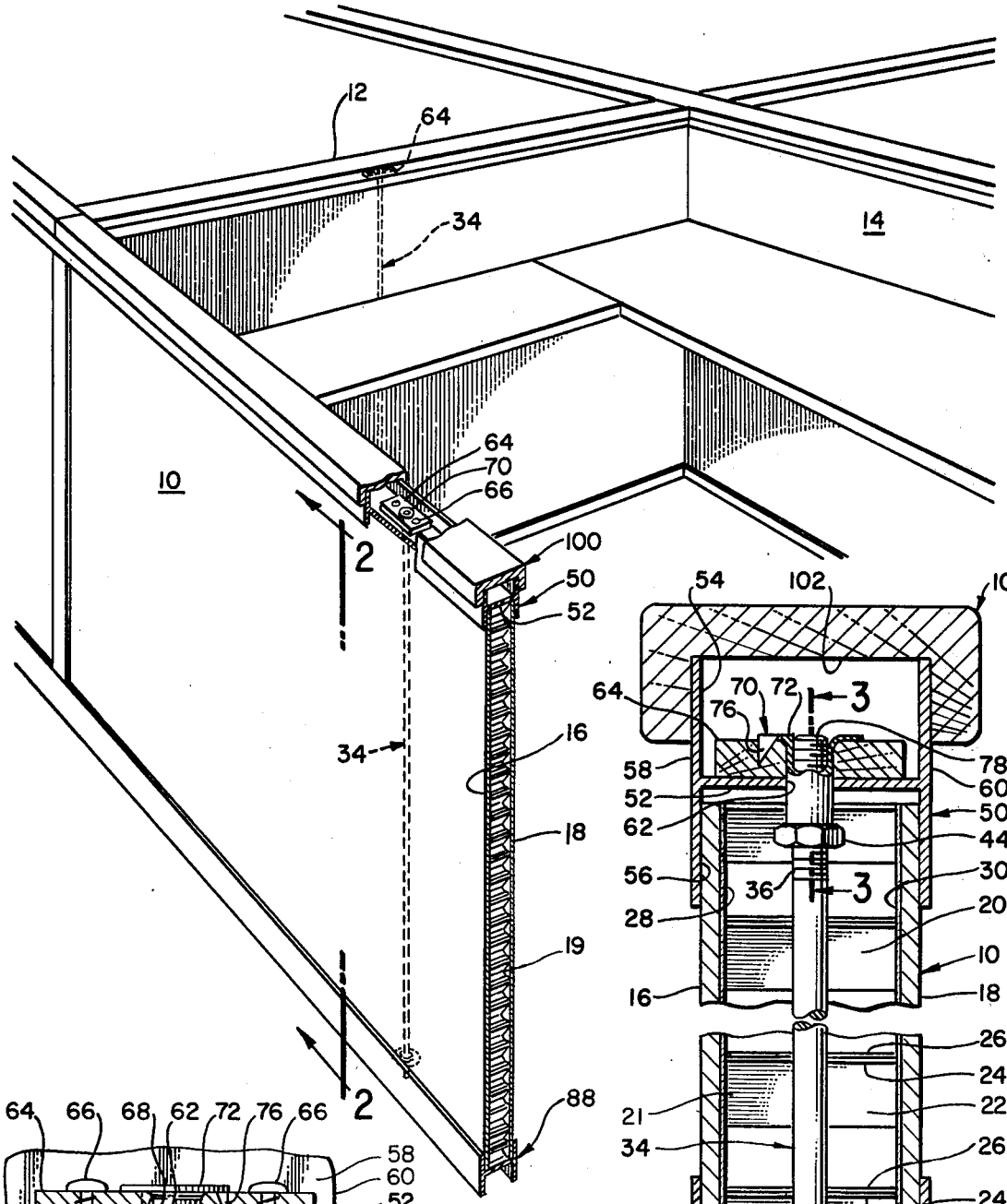
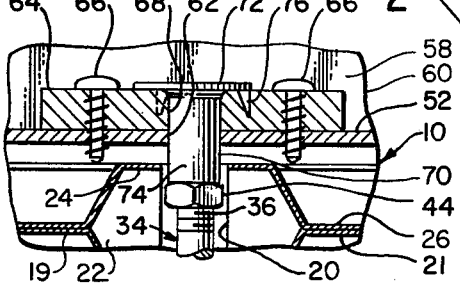
FIG. 3.
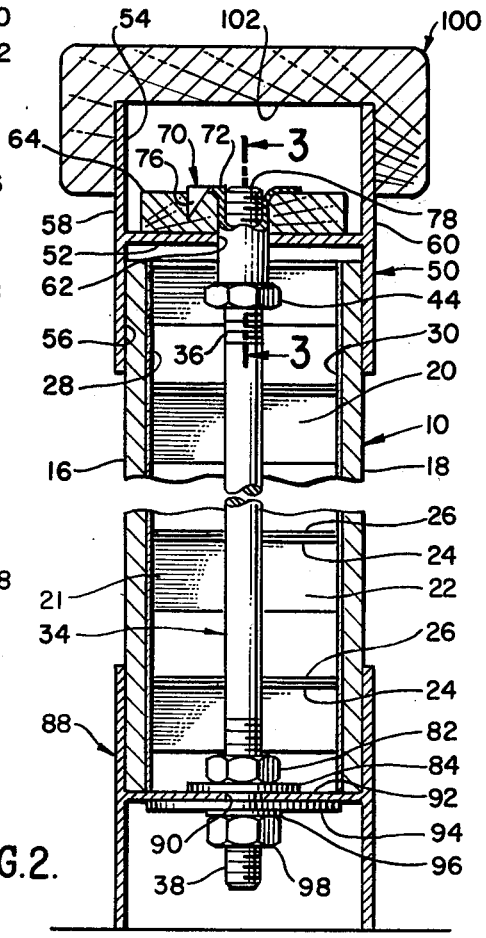
FIG. 2.

PARTITION HAVING STABILIZING BAR AND METHOD

BACKGROUND OF THE INVENTION

The invention relates to prefabricated partitions typically used to form office spaces for personnel. Wall forming partitions are typically made or cut to specified measurements and transported in substantially finished condition to their place of installation.

In the manufacture of such partitions the problems to be solved have been to make them attractive, lightweight, of adequate strength, and relatively inexpensive. Solutions to the foregoing problems have been accomplished in the present invention.

SUMMARY OF THE INVENTION

It is an object of the present invention to provide improved space separating and arranging partitions and the method for making the same, the partitions being attractive, lightweight, of more than adequate strength, and economical to manufacture and install.

It is another object of the invention to provide a partition, as described in the previous paragraph, formed of decorative panels secured to a spacing paper honeycomb structure.

It is a still further object of the invention to provide a partition, as described in the preceding paragraphs, in which stabilizing bars are provided at intervals of approximately every two and one-half feet when the partition extends longitudinally for approximately five feet.

It is a further object of the invention to provide a partition, as described in the preceding paragraphs, in which the stabilizing bar is moved into place by inserting it through a space between paper honeycomb sections which space the partition panels, and securing it to the H-bars of the H-shaped members which are fitted along two opposite ends of the partition. The stabilizing bar is generally positioned vertically parallel to the direction of the partition and is employed to provide adequate strength to the partition to support forces that may be applied to it.

It is a still further object of the invention to provide a partition, as described in the preceding paragraphs, in which the stabilizing bar is of predetermined length and is fitted into the partition so that its leading end terminates at a predetermined location. This method of inserting the bar provides for a quick installation and requires no further adjustments as to the position of the bar.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is a perspective view of partitions according to the invention, illustrating the location of stabilizing bars therein;

FIG. 2 is a cross-sectional view of the partition and stabilizing bar, taken along the line 2—2 in FIG. 1;

FIG. 3 is a fragmentary cross-sectional view, taken along the line 3—3 in FIG. 2.

DESCRIPTION OF THE PREFERRED EMBODIMENT

Referring again to the drawings, there is shown in FIG. 1 an arrangement of office space forming partitions, such as 10, 12 and 14. As shown in FIGS. 1–3 the partitions are formed by two opposite spaced panels 16 and 18, the panels typically being made of plastic laminations, hardboard or wood veneer having a decorative surface. Spacing the panels are two sections 19, 21 of honeycomb structures made of paper. The two sections are spaced by a channel 20 within the panels. The honeycomb has horizontal passages 22 formed of six sides and extend substantially perpendicular to panels 16 and 18. Two of the six sides forming the passages are upper horizontal side 24 and lower horizontal side 26, each of these sides being glued to a contiguous upper or lower side. The ends of the passages are closed by paper sheets 28 and 30 which are glued to the edges of the sides forming the passages. In turn the outer surfaces of the sheets 28 and 30 are glued to the inner surfaces of the panels 16 and 18, respectively.

It has been found that when the partitions, as 10, extend horizontally for 5 feet or more some additional support is needed to render the partition secure against forces which may be applied to it. Weight applied from above, for example, may cause a 5 ft. partition to bow in the center without the provision of a stabilizing bar 34. The bar 34 is shown in the form of a cylindrical rod and has threads 36 and 38 at its opposite ends. In the manufacture of the partition, the bar 34 is inserted from what is the upper end of the partition in FIG. 2 and moved downwardly in the channel 20 which guides the bar centrally downwardly. After the bar is in approximate desired position, a nut 44 is engaged on the threads 36 as far down as it will go from the top end.

When the bar is so positioned, it is then ready to be engaged with an upper H-shaped member 50. The H-shaped member 50 has an H-bar 52 which forms a common channel bottom for an upwardly extending channel 54 and downwardly extending channel 56. Extending from the ends of the bar are opposite channel legs 58 and 60. The lower ends of the channel legs fit over the marginal upper end edges of the panels 16 and 18 so that the bar 52 is spaced from the top panel edges about $\frac{1}{4}''$ when assembly is completed. This provides clearance for irregularly cut panels.

A cylindrical hole 62 is drilled into the bar 52 so as to be in alignment with the stabilizing bar 34. A wooden strip 64 are secured to the top of the bar 52 by means of two metal screws 66. The strip has a cylindrical opening 68 in alignment with and of the same size as the opening 62 in the bar 52. A T-nut 70 has a cylindrical plate 72 forming an upper T-bar in side view and has a cylindrical T-leg 74, having an outside diameter to fit into the openings in the strip and the H-bar. The T-nut is secured to the strip and extends through the H-bar and is secured to the wood strip by sharply pointed tabs 76 forced therein. The T-nut has a threaded central opening 78 adapted to receive the threads 36 on the upper end of the stabilizing bar 34.

Prior to fitting the H-shaped member 50 over the panels, the bar 34 is threaded into the opening 78 until its upper end is flush with the top of the T-bar 72. The nut 44 is then wrench tightened to abut the lower end of the T-nut. The H-shaped member 50 is then slipped over the panels as far as it will go.

At the lower end 38 of the bar 34, a nut 82 is threadedly positioned as far as it will go and a washer 84 is slipped over the end 38. A second H-shaped member 88, having a centrally positioned opening 90 through its H-bar 92, is adapted to be fitted over the lower end edges of the panels so that the end 38 extends through the opening 90.

Because the upper panels are to be spaced from the H-bar 52, jigs are used to determine the proper positions of the nut 82 and the washer 84, and hence the position of the H-shaped member 88. One jig, a metal channel, is placed on a panel to have an end abut a lower end of leg 58 and the other end of the first jig is positioned against the second jig which is in H-shaped form to fit over the lower end of the panels. The length of the first jig is such to properly space the H-shaped member 50 and the second jig. The second jig exposes the nut 82 so that it can be tightened with the washer 84 against the second jig. This positions the nut 82 and washer 84 to properly position the H-shaped member 88 when its opening 90 is slipped over the end of the bar 34, the H-bar 92 abutting the washer 84, and assures that H-shaped members 50 and 88 will be parallel.

After the H-bar 92 is so positioned, a larger fender washer 94, to spread the stress, and lock washer 96 are slipped over the end 38 and a nut 98 is threadedly engaged therewith to tighten the bar 34 to the upper and lower H-shaped members and to tighten them on the partition. This arrangement provides very substantial added strength to the partition to prevent bowing of the upper H-shaped member when weight is applied downwardly and when the partitions are carried by gripping the upper H-member.

A decorative wooden rail 100, having a downwardly opening channel 102, is fitted over the upper channel legs 58 and 60 of the member 50 to provide an attractive finish to the upper end of the partition. The lower end of the partition stands on the lower legs of the H-shaped member 88 and is made secure by being joined to other partitions, such as shown in FIG. 1 where partitions 10, 12 and 14 are joined at their ends.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A partition comprising:

two spaced panels forming outer wall surfaces, means spacing said panels, elongated H-shaped members fitted on each of two opposite respective ends of said panels, each H-shaped member forming an inwardly and an outwardly facing channel, said inwardly facing channels each having a bottom adjacent edges of said panel ends and having inner faces of its side walls adjacent marginal portions of said wall surfaces, a partition stabilizing bar extending between said panels, adjacent said means spacing, and through both channel bottoms at both ends of said panels, said bar being threaded at both ends, nut means fixed to a channel bottom and extending therethrough at one end of said panels, one end of said bar being threadedly engaged with said nut means, a nut on said bar adjacent said one end thereof positioned to limit the engagement of said bar with said nut means, and nuts on said bar adjacent the other end thereof tightening said bar to said channel bottoms at the other end of said panels, whereby said H-shaped members are secured to said panels and said bar prevents bowing or collapse of said partition in the direction of said bar.

2. The invention according to claim 1 in which:

said bar is centrally positioned with respect to the longitudinal direction of said partition, said last direction being transverse to said bar.

3. The invention according to claim 1 in which:

said means spacing are at least two sections of honeycomb structures formed of paper, said sections having a space therebetween extending between said panels, passages in said honeycomb extending generally perpendicular to said panels and to said bar, sheets of paper fixed to said honeycomb structure on both opposite ends of said passages, said sheets abutting inner surfaces of said panels and being fixed thereto, said bar being inserted between said panels by being inserted into said space between said sections and extending generally parallel to said panels.

4. The invention according to claim 3 in which said nut means includes:

a wooden strip secured on the outer channel bottom at said one end of said panels, a T-nut secured to and extending through said strip and through said channel bottoms, said T-nut having a T-bar formed of a plate, said plate having sharp tabs extending therefrom and secured in said strip, a T-leg extending from the T-bar and extending through said strip and bottoms, a threaded hole through said T-bar and T-leg in which said one end of said stabilizing bar is threadedly engaged, said one end of said stabilizing bar having an outermost surface flush with said plate, said nut on said stabilizing bar adjacent said one end thereof being in abutment with said T-leg.

5. The invention according to claim 4 in which said nuts adjacent the other end of said stabilizing bar include:

a nut inwardly of said inwardly facing channel bottom spaced from said last bottom by a washer abutting said last bottom and said last nut, a nut outwardly of said outwardly facing channel bottom spaced from said last bottom by a lock washer and a large diameter washer, said last washer abutting and extending substantially across said last bottom.

6. The invention according to claim 5 including:

a channel-shaped finishing railing fitted on said outwardly facing channel at said one end.

7. A method of making a partition comprising:

securing a pair of wall forming panels on opposite sides of two aligned sections of paper honeycomb structures, a space being between said sections and said panels, said panels being parallel, said honeycomb having passages generally perpendicular to said panels, inserting a stabilizing bar, having threaded portions adjacent its ends, into the space between said honeycomb sections transversely to said passages and generally centrally between said panels, one end of said stabilizing bar being adjacent one end of said panels and the other end of said stabilizing bar being adjacent the other end of said panels, preparing elongated members, H-shaped in cross section, for fitting over said ends of said panels and for connection to said bar, said preparing including drilling centrally positioned holes through centrally positioned H-bars of said members, said holes being alignable to receive said stabilizing bar ends when said members are fitted over said panel ends, threading a first nut on said one end of said stabilizing bar, securing a T-nut in the hole in one of said H-bars, threading said one end of said stabilizing bar into said T-nut until the outer end surface of said one end of said stabilizing bar is adjacent an outer end surface of said T-nut, tightening said first nut until it abuts an inner surface of said T-nut, fitting said H-shaped member, having said T-nut secured therein, over one end of said panels so that legs of said H-member fit over said panels and the H-bar of said H-member is adjacent said one end edge of said panels, threading a second nut on the other end of said stabilizing bar and slipping a washer on said stabilizing bar in abutment with said second nut, determining the proper location of said second nut with measuring jigs and positioning said second nut and said last washer on said stabilizing bar as determined by said jigs, and placing said other H-shaped member over said other end of said panels with the other end of the stabilizing bar extending through the hole in its H-bar, said last washer being in abutment with the inside of the H-bar, slipping a large fender washer on said other end of said stabilizing bar to abut the outside of said last H-bar, and tightening a third nut on the other end of said stabilizing bar to abut said large washer and to secure said other H-shaped member to said panels to properly position said H-members on said panels.

* * * * *